United States Patent [19]

Ogawa et al.

[11] 4,180,160

[45] Dec. 25, 1979

[54] WET TISSUE CONTAINER

[75] Inventors: Kiyohisa Ogawa, Funabashi; Seiji Eshima, Mitaka, both of Japan

[73] Assignee: Wakodo Kabushiki Kaisha, Tokyo, Japan

[21] Appl. No.: 929,720

[22] Filed: Jul. 31, 1978

[30] Foreign Application Priority Data

Aug. 10, 1977 [JP] Japan ..... 52-107297[U]

[51] Int. Cl.[2] ..... B65D 81/22; B65D 83/00; B65H 1/00; B65F 3/00

[52] U.S. Cl. ..... 206/210; 221/63; 225/106

[58] Field of Search ..... 206/210, 205; 221/63, 221/48; 225/106

[56] References Cited

U.S. PATENT DOCUMENTS

| | | | |
|---|---|---|---|
| 3,749,296 | 7/1973 | Harrison | 206/205 |
| 3,843,017 | 10/1974 | Harrison | 206/210 |
| 4,017,002 | 4/1977 | Doyle et al. | 206/205 |

*Primary Examiner*—William T. Dixson, Jr.
*Attorney, Agent, or Firm*—Alfred E. Miller

[57] ABSTRACT

A wet tissue container wherein a length of tissue strip is drawn from a roll of tissue immersed partly in and moistened with a suitable liquid through a fine diameter tissue drawing hole formed through a wet tissue drawing member made of a material having high elasticity.

5 Claims, 10 Drawing Figures

Prior Art
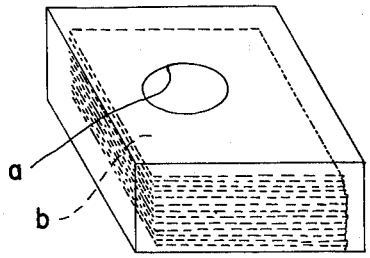
Fig. 1
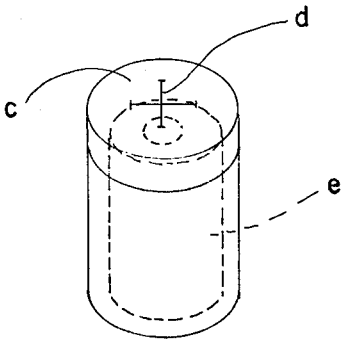
Fig. 2
Fig. 3
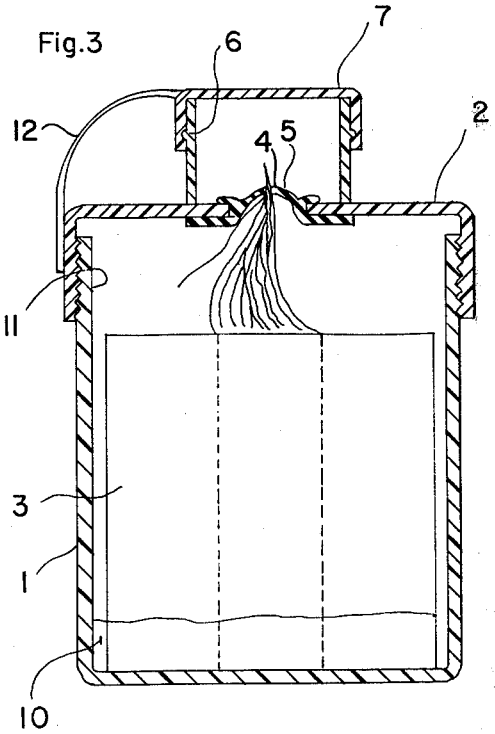
Fig. 4A
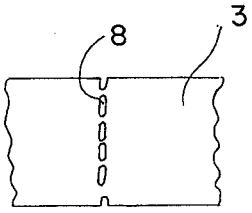
Fig. 4 B
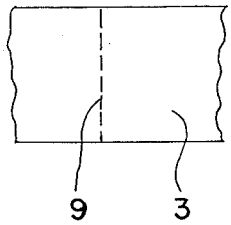

WET TISSUE CONTAINER

The present invention relates to a wet tissue container which permits the continuous tissue dispensing and minimizes the vaporization of a liquid in the container.

BACKGROUND OF THE INVENTION

Wet tissues moistened with a suitable liquid such as a toilet water or a face lotion have been used widely, for example as beauty aids.

Known wet tissue containers have drawbacks that hamper their desirability. In this regard FIG. 1 shows a prior art wet tissue container in which a large number of wet tissues b are stacked in superposed relation. A user may insert her fingers through an opening a formed through the top of the container, grip the topmost tissue and withdraw it through the opening a. This prior art wet tissue container has the defect that when the opening a is maintained in an open condition, a moistening liquid vaporizes so that the wet tissues in the container are therefore dried.

FIG. 2 shows another prior art wet tissue container in which is disposed a roll of wet tissue having equidistantly spaced perforated lines. Cruciform slits d are cut through a cover c made of an elastic material. When the wet tissue e is unrolled and drawn through these slits d, the latter serves to squeeze excess liquid contained in the tissue and as a guide for tearing a tissue along a perforated line and to futhermore hold the leading end of the continuous wet tissue from the roll so that the next tissue sheet may be readily grasped and drawn out. This wet tissue container has also some serious drawbacks in that the side edges of the slits d must be directed upwards so as to facilitate the passage of the wet tissue through the slits d when the tissue is drawn. However, when the tissue is drawn through the slits and torn off, the side edges thereof must spring back so as to close the slits d as tightly as possible in order to prevent the vaporization of the moistening liquid through the slits. As a result, the slits d must be cut with a high degree of accuracy, and consequently the cost of manufacture is increased. Moreover, the leading end of the tissue is held in the slits d, so that there is an opening into the container and the vaporization of the moistening liquid through the slits d cannot be avoided. Moreover, when the container is turned upside down, the moistening liquid accumulated at the bottom of the container will flow out of the slits.

The present invention was made to overcome the above drawbacks encountered in the prior art wet tissue containers and will become apparent from the following description of one preferred embodiment thereof taken in conjunction with the accompanying drawings, in which:

FIGS. 1 and 2 are perspective views of prior art wet tissue containers;

FIG. 3 is a vertical sectional view of a wet tissue container constructed in accordance with the present invention;

FIGS. 4A and 4B show perforated lines in continuous tissues;

DESCRIPTION OF PREFERRED EMBODIMENTS

Figure 5A:
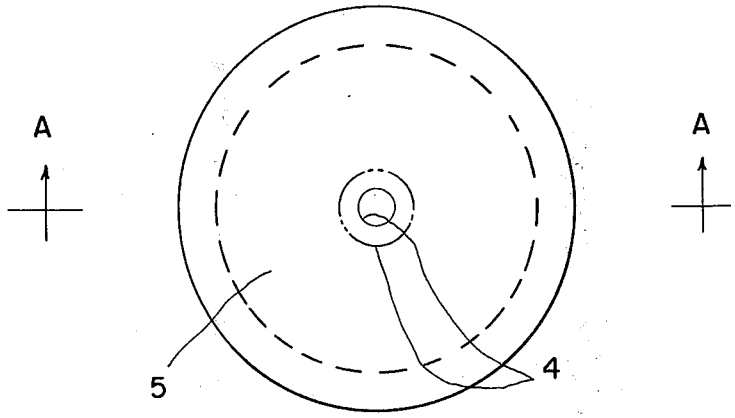
FIG. 5A is a top view of a wet tissue drawing member.

Referring to FIGS. 3 through 5B, a wet tissue container in accordance with the present invention comprises in general a main body or receptacle 1 which is made of plastic and in which is stored a roll of tissue 3 and a screw threaded cap 2 which is made of plastic and is connected to the mating screw-threaded upper portion of the main body 1 to close its open upper end.

The cap 2 has a center opening into which is fitted a dome-shaped wet tissue drawing member 5. The member 5 is made of a soft rubber and is formed at the apex with a small, tissue drawing hole 4 about one millimeter in diameter. A cylindrical protective neck 6 is extended from the top of the cap 2 coaxially thereof so as to surround the wet tissue drawing member 5. The open top end of the cylindrical neck 6 is fitted with a protective cap 7 in order to prevent the adhesion of dust and bacteria to the leading end of the wet tissue strip exposed out of the drawing hole 4. The cap 7 is permanently attached to cap 2 by means of a flexible strip 12.

As shown in FIGS. 4A and 4B the wet tissue strip is formed with perforated lines 8 or 9 which are spaced apart from each other by a suitable distance. The roll of wet tissue 3 is partly immersed in and moistened with a suitable moistening liquid 10 such as a toilet water (FIG. 3). Instead of the roll, the tissue 3 may be folded in a zig-zag form.

The mode of operation of the present wet tissue container or dispenser will now be described. First, a user removes the cap 2 from the main body 1, places the roll of tissue 3 in the main body 1 and fills and the main body 1 with toilet water 10. The leading end of the tissue strip 3 is unrolled and inserted through the drawing hole 4 so as to be slightly extended out of it into the protective cylindrical neck 6. Thereafter the cap 2 is fitted over the main body.

When a user needs the tissue, she or he removes the protective cap 7 from the neck 6 and grips and draws the leading end of the tissue strip. Then the tissue is twisted and compressed as it is drawn through the hole 4 so that the excessive moistening liquid 10 may be squeezed out of the tissue. In this manner, the moisture content of the tissue 3 drawn out of the main body 1 may be suitably controlled. The drawn tissue is torn off along a perforated line 8 or 9 in such a way that the leading end of the tissue strip remains slightly extended or projecting out of the drawing hole 4. Thus, when the leading end of the tissue strip is initially inserted through the drawing hole 4 in the manner described, the wet tissue may be continuously drawn out of the wet tissue container.

Figure 5B:
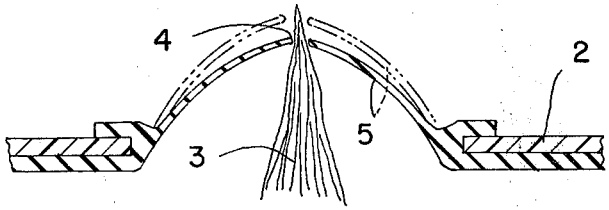
FIG. 5B is a sectional view thereof taken in the direction indicated by arrows A of FIG. 5A.

Since the wet tissue drawing member 5 is made of a soft rubber having a high elasticity, when the tissue 3 is drawn out of the drawing hole 4, the latter is widened or increased in diameter as indicated by dot-dash lines in FIGS. 5A and 5B so that the drawing of tissue may be facilitated. However, when the tissue is not drawn, the drawing member 5 and its drawing hole 4 may return to its initial form and exerts suitable pressure against the tissue in the opening 4 because of the elasticity of the wet tissue drawing member 5. As a result, the vaporization of the moistening liquid or toilet water 10 may be minimized and the leakage through the drawing hole 4 of the moistening liquid 10 may be prevented, even when the container is turned upside down. Therefore the wet tissue container may be installed upside down so that the tissue may be drawn from the side of the wet tissue container facing downwardly. Furthermore, because of the elasticity of the wet tissue drawing member 5, various types of tissues which are different in thickness may be selectively used with the present wet tissue container.

After the required length of tissue has been drawn out, the protective cap 7 is fitted over the protective neck 6 so that the sanitary condition of the tissue exposed out of the drawing hole 4 into the protective neck 6 may be maintained; that is, the adhesion of dust and bacteria to the exposed tissue may be avoided.

Figure 6:
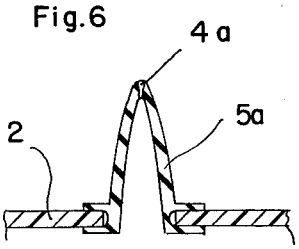
FIGS. 6, 7 and 8 are sectional views of modifications of the wet tissue drawing member.

FIG. 6 shows a modification of the tissue drawing member. The wet tissue drawing member 5*a* which is also made of a soft rubber is in the form of a cone with a relatively small semivertical angle so that as the tissue approaches the drawing hole 4 more compressive forces may be imparted to the tissue and that therefore the smooth drawing of tissue from the main body 1 results.

Figure 7:
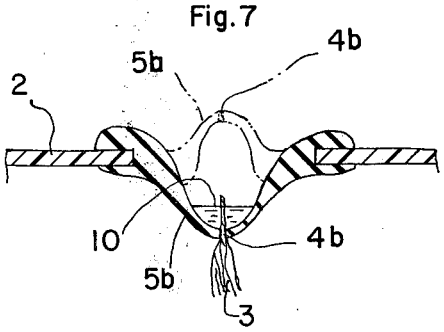

In another modification shown in FIG. 7, the wet tissue drawing member 5*b* which is made of a soft rubber is in the form of a cup. When the tissue is drawn through the drawing hole 4*b*, the wet tissue drawing member 5*b* is raised into an inverted cup form, as indicated by dot-dash lines. After a desired length of tissue has been squeezed through the drawing hole 4*b* and torn off, the wet tissue drawing member 5*b* returns to its initial cup shape form. The toilet water 10 squeezed out of the drawn tissue and trickled out of the drawing hole 4*b* may be accumulated in the recess, as shown, and used advantageously to moisten the trailing tissue strip.

Figure 8:
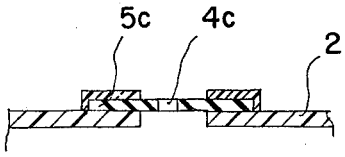

In a further modification shown in FIG. 8, the wet tissue drawing member 5*c* is made of a soft rubber and is in the form of a disk formed with a center opening 4*c* three millimeters in diameter.

With the modified wet tissue drawing members described above, the wet tissue containers in accordance with the present invention may store various types of tissues.

Instead of a soft rubber, the wet tissue drawing member 5 with the drawing hole 4 may be made of any suitable material which is as elastic or a soft rubber. With a material having an extreme high elasticity, the drawing hole 4 may be made in the form of a pin hole so that the leakage of the moistening liquid may be completely prevented, even when the wet tissue container is turned upside down.

The features and advantages of the present invention will be described in comparison with the prior art wet tissue container of the type having cruciform slits as shown in FIG. 2. As the tissue is drawn through the cruciform slits, it partly engages with the side edges of the slits so that the drawn tissue has a portion which has been squeezed and a portion which has not been squeezed at all. In other words, it is impossible to draw out of the prior art wet tissue container a tissue which is uniformly moistened. However, according to the present invention, when the tissue is drawn through the drawing hole, the contracting forces of the wet tissue drawing member exert uniform squeezing forces against the tissue being drawn. Therefore, the drawn tissue is suitably and uniformly moistened.

With the prior art wet tissue containers, the tissue may be drawn out of it only in the upward direction, but with the wet tissue container in accordance with the present invention, the tissue may be drawn out of the container in any desired direction and may be positively torn off. Therefore, the wet tissue container in accordance with the present invention is very convenient in use and is effective in operation.

The features and advantages of the wet tissue container of the present invention having the above construction may be summarized as follows:

(I) The continuous drawing of the tissue may be permitted.

(II) The vaporization of a moistening liquid in the container may be substantially eliminated. Furthermore, the leakage of a moistening liquid may be prevented even when the wet tissue container is turned upside down so that the tissue may be drawn from the end of the wet tissue container facing downwardly.

(III) The drawn out tissue is uniformly and suitably moistened.

(IV) Even when the tissue may be drawn out in any direction, it may be positively torn off from the trailing tissue strip.

(V) Various types of tissue may be stored in the containers.

(VI) Because of excellent sealing properties of the present invention, even heated wet tissues may be stored in the container.

(VII) The wet tissue container in accordance with the present invention is very simple in construction. As a result, the cost may be considerably reduced and satisfactory performance is ensured.

What is claimed is:

1. A wet tissue container comprising a receptacle for storing and dispensing a length of tissue strip having spaced perforation lines, a liquid in said receptacle, a cap removably connected to receptacle and provided with a wet tissue drawing member therein, said drawing member being dome-shaped and constituted of a material of high elasticity, and a tissue drawing hole in the apex of said drawing member having a fine diameter whereby when said wet tissue is drawn through said drawing hole excessive moistening liquid in said tissue is squeezed therefrom and returned to said receptacle.

2. A wet tissue container as claimed in claim 1 further comprising a cylindrical neck fixed to said cap and surrounding said drawing hole, an additional removable cap secured to said cylindrical neck and positioned over said drawing hole to prevent the adhesion of dust and bacteria to the leading end of said wet tissue strip projecting out of said drawing hole.

3. A wet tissue container as set forth in claim 1 wherein said wet tissue drawing member is in the form of a cone having a relatively small semivertical angle; and said tissue drawing hole is formed at the apex of said cone-shaped wet tissue drawing member.

4. A wet tissue container as set forth in claim 1 wherein said wet tissue drawing member is in the form of a cup extended into said main body; and said tissue drawing hole is formed at the deepest bottom of said cup-shaped wet tissue drawing member, and said drawing member being adapted to assume an inverted cup shape when said wet tissue is drawn through said drawing hole.

5. A wet tissue container as set forth in claim 1 wherein said wet tissue drawing member is in the form of a disk or ring; and said tissue drawing hole is formed at the center of said disk- or ring-shaped wet tissue drawing member.

* * * * *